US007399134B2

(12) United States Patent
Gueret

(10) Patent No.: US 7,399,134 B2
(45) Date of Patent: Jul. 15, 2008

(54) PACKAGING AND APPLICATOR DEVICE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 18 days.

(21) Appl. No.: 10/766,866

(22) Filed: Jan. 30, 2004

(65) Prior Publication Data

US 2004/0202502 A1 Oct. 14, 2004

Related U.S. Application Data

(60) Provisional application No. 60/459,623, filed on Apr. 3, 2003.

(30) Foreign Application Priority Data

Feb. 7, 2003 (FR) ..... 03 01513

(51) Int. Cl.
*A45D 33/00* (2006.01)
*A46B 11/00* (2006.01)

(52) U.S. Cl. ..... 401/130; 401/126; 215/258; 215/253

(58) Field of Classification Search ..... 401/118, 401/126–130; 215/252, 253, 258
See application file for complete search history.

(56) References Cited

U.S. PATENT DOCUMENTS 4,219,283 A * 8/1980 Buckley et al. ..... 401/129
4,489,843 A * 12/1984 Drozd, Jr. ..... 215/252
4,592,476 A * 6/1986 Yasada ..... 215/252
4,841,996 A * 6/1989 Gueret ..... 132/320
6,024,507 A 2/2000 Joulia

FOREIGN PATENT DOCUMENTS

| | | |
|---|---|---|
| DE | 196 42 610 A1 | 3/1998 |
| DE | 101 04 042 A1 | 8/2002 |
| JP | A-47-045072 | 11/1972 |
| JP | U-54-136167 | 9/1979 |
| JP | A-59-174458 | 10/1984 |
| JP | U-1-122452 | 8/1989 |
| JP | A-2000-201729 | 7/2000 |

* cited by examiner

*Primary Examiner*—David J Walczak
(74) *Attorney, Agent, or Firm*—Oliff & Berridge, PLC

(57) ABSTRACT

A flask may include a threaded neck and an applicator. In embodiments, the applicator includes a stem, an applicator element disposed at a first end of the stem, and a closure cap supporting the stem at a second end of the stem opposite from the first end. The closure cap may have a threaded portion arranged to screw onto the neck. The closure cap may include a ring releasably connected to the threaded portion and arranged to be capable of remaining secured to the neck during removal of the applicator from the flask.

32 Claims, 3 Drawing Sheets

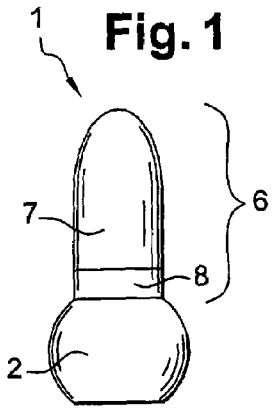
Fig. 1
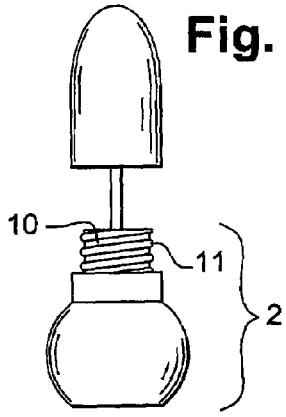
Fig. 2
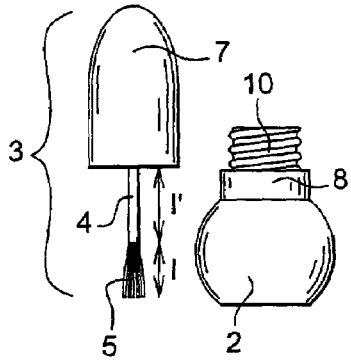
Fig. 3
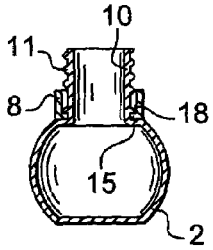
Fig. 5
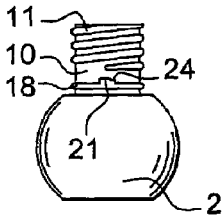
Fig. 4
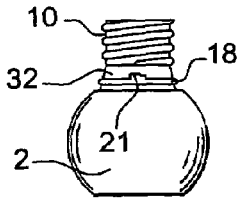
Fig. 13
Fig. 6
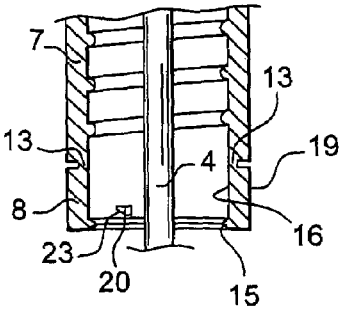
Fig. 7
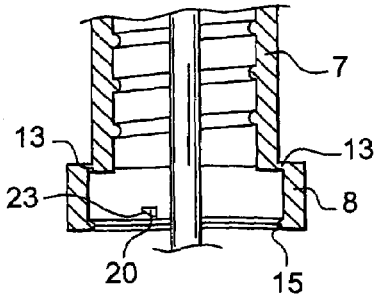
Fig. 8
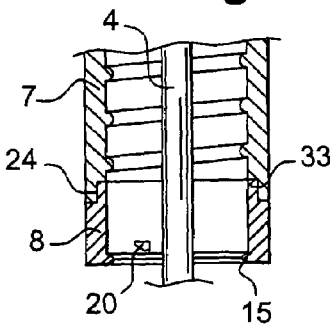

PACKAGING AND APPLICATOR DEVICE

This application claims the benefit of French Application No. 03 01513 filed on Feb. 7, 2003 and U.S. Provisional Application No. 60/459,623 filed on Apr. 3, 2003, the entire disclosures of which is incorporated by reference herein.

FIELD OF INVENTION

The present invention relates to packaging and applicator devices for cosmetics or other care products, and more particularly but not exclusively those that are intended for applying varnish to nails.

BACKGROUND

Nail varnish flasks that are currently on the market have a variety of capacities, usually lying in the range of 7 milliliters (ml) to 14 ml. The associated applicators comprise a stem having a brush at one end and a closure cap having a threaded portion.

For flasks of relatively large capacity, for example, 12 ml or more, the height of the flask body makes it possible to use a stem that is relatively long. In contrast, for flasks of small capacity, the height of the flask body is smaller. Therefore, the stem needs to be shorter. Otherwise, the length of the bristles of the brush needs to be shorter, which would lead to a loss of flexibility and a loss in quality of application. Otherwise, the length of the neck needs to be increased, which may degrade appearance.

SUMMARY OF THE INVENTION

Exemplary embodiments of the invention provide a packaging and applicator device that has both bristles that are relatively long and a visible length of stem that is of sufficient length to make application easier.

Exemplary embodiments of the invention provide a packaging and applicator device comprising: a flask having a threaded neck; and an applicator comprising a stem, an applicator element disposed at a first end of the stem, and a closure cap supporting the stem at a second end opposite from the first end, the closure cap including a threaded portion arranged to screw onto the neck. In embodiments, the closure cap may include a ring that is releasably connected to the threaded portion and arranged to be capable of remaining secured to the neck during removal of the applicator from the flask.

Exemplary embodiments of the invention render it possible to benefit from a visible length of stem plus an applicator element that is relatively large, but without harming the appearance of the flask, for example, because of the provision of the ring at the base of the neck. Further, the ring may placed in a manner that is relatively easy and inexpensive, for example, after the flask has been filled.

Exemplary embodiments of the invention render it possible to make the ring and the threaded portion in such a manner as to give the impression, when the applicator is placed on the flask, of a closure cap that is made as a single piece, which may be desirable in terms of appearance.

As used throughout the description of the invention, the term "threaded portion" should be understood broadly as corresponding to a portion of the closure cap that includes at least one thread. Such a thread may be implemented, where appropriate, on an insert fixed within an outer cap. In such a case, the ring may be releasably connected to the insert and/or to the outer cap.

In embodiments, the ring may optionally include a thread.

In exemplary embodiments, the ring may have at least one first portion in relief that enables the ring to be snap-fastened onto at least one second portion in relief formed on the neck. The second portion in relief may comprise, for example, an annular bead. The first portion in relief may comprise, for example, an annular bead or teeth that project from a radially inner surface of the ring.

In exemplary embodiments, the ring may have at least one portion in relief arranged to retain the ring on the neck by friction.

In exemplary embodiments, the ring may have one or more splines on an inner surface thereof.

In exemplary embodiments, the ring and the threaded portion may or may not be made monolithically.

In exemplary embodiments, the ring may advantageously be made at least in part by molding a plastics material with the threaded portion. For example, the ring may be made at least in part by molding a plastics material with the outer cap when the threaded portion comprises an insert and an outer cap. In exemplary embodiments, the ring may be connected to the threaded portion by one or more breakable bridges of material.

In exemplary embodiments, the ring may be disposed on the threaded portion, for example, fitted thereto, with the threaded portion and the ring being made in different molds, for example. For example, in exemplary embodiments the ring may have a portion in relief that enables the ring to co-operate by mutually engaging with the threaded portion. The ring thus need not be connected to the threaded portion by breakable bridges of material.

In exemplary embodiments in which the ring and the threaded portion are not made monolithically, the ring and the threaded portion may be connected to each other by one of friction, snap-fastening, welding and adhering.

The ring and the threaded portion may also be connected to each other by other fastening means, either known or hereafter developed.

In exemplary embodiments, the neck may have at least one first anti-rotation portion in relief and the ring may have at least one second anti-rotation portion in relief arranged to co-operate with the first anti-rotation portion in relief. Such an arrangement may help to prevent the ring from turning relative to the neck while the closure cap is being unscrewed to separate the threaded portion from the ring.

In exemplary embodiments, the first anti-rotation portion in relief on the flask may be arranged to allow the second anti-rotation portion in relief to rotate past the first anti-rotation portion in relief on initial tightening of the closure cap onto the flask. Further, in exemplary embodiments, at least one of the first and second anti-rotation portions in relief may include a ramp which may make it easier for the first and second anti-rotation portions in relief to move past each other.

In exemplary embodiments, the ring may be prevented from turning on the neck by clamping the ring onto the neck. For example, the ring may be clamped onto the neck in exemplary embodiments in which the ring has one or more splines on an inside surface thereof.

In exemplary embodiments, at a base of the neck, the neck may have a surface that is cylindrical or may have a surface that flares toward a body of the flask. In such embodiments, the ring may be brought to bear against the surface at the base of the neck with a desired degree of clamping force.

In exemplary embodiments, the ring may be decorated.

In exemplary embodiments, the flask may be made in a variety of shapes. For example, in exemplary embodiments, the flask may have a shoulder at the base of the neck.

In exemplary embodiments, the flask may be made of glass and/or plastics material. For example, in exemplary embodiments, the flask may be made of transparent material.

In exemplary embodiments, the content of the flask may be less than or equal to about 10 ml. For example, the content of the flask may be less than or equal to about 8 ml. For example, the content may lie in a range of about 7 ml to about 5 ml.

In exemplary embodiments, a visible length of the stem and the applicator element may be greater than or equal to about 25 millimeters (mm), for example. In exemplary embodiments in which the applicator element is a brush, the visible length of a free portion of the bristles may be greater than or equal to about 12 mm, for example.

In exemplary embodiments, the flask may contain a substance for application to nails, for example, a nail varnish. In other exemplary embodiments, the flask may contain a substance for application to the face, for example, to the lips. In such embodiments, the flask may include a wiper member, for example.

In exemplary embodiments, the applicator element may be flocked. For example, the applicator element may be flocked in exemplary embodiments in which the applicator element is for application on skin or lips.

In exemplary embodiments, a length of the stem may be substantially equal to a height of the neck. For example, the length of the stem may be equal to the height of the neck to within about 30%.

In exemplary embodiments, a length of the applicator element may be substantially equal to a height of the flask body on which the neck is connected. For example, the length of the applicator element may be equal to the height of the flask body to within about 30%.

Exemplary embodiments of the invention provide a method of manufacturing a packaging and applicator device, the method comprising: screwing onto a flask having a threaded neck an applicator comprising a stem, an applicator element disposed at a first end of the stem, and a closure cap to which the stem is secured at a second end opposite from the first end, the closure cap having a threaded portion that is arranged to be screwed onto the neck and a ring that is releasably connected to the threaded portion at a base of the closure cap, the neck and the ring having shapes that co-operate to retain the ring on the neck when the threaded portion is unscrewed, for example, during use.

In exemplary embodiments, the neck and the ring may co-operate, for example, by snap-fastening or friction.

Exemplary embodiments of the invention provide a method of manufacturing a packaging and applicator device, the method comprising: screwing a threaded insert, to which the applicator element is secured, onto a flask having a threaded neck; and fitting an outer cap on the insert, the outer cap being connected releasably to a ring, the outer cap and the insert remaining secured to each other when the insert is unscrewed, the neck and the ring having shapes that co-operate to retain the ring on the neck when the insert is unscrewed.

BRIEF DESCRIPTION OF THE DRAWINGS

The invention can be better understood on reading the following detailed description of non-limiting embodiments of the invention and on examining the accompanying drawings, in which:

FIG. 1 is a diagrammatic elevation view of an exemplary embodiment of a packaging and applicator device according to the invention;

FIG. 2 is a view analogous to FIG. 1, showing the exemplary device in FIG. 1 during initial unscrewing of the closure cap;

FIG. 3 is a view analogous to FIG. 1, showing the applicator fully withdrawn from the flask;

FIG. 4 shows the flask in isolation without the ring or the closure cap;

FIG. 5 is a diagrammatic axial section view of the flask shown in FIG. 3;

FIG. 6 is a diagrammatic and fragmentary axial section view of the closure cap of the exemplary device shown in FIGS. 1 to 3;

FIGS. 7 and 8 are diagrammatic and fragmentary axial section views showing various exemplary embodiments of the closure cap;

FIG. 13 is a diagrammatic elevation view of another exemplary embodiment of the flask in isolation;

DETAILED DESCRIPTION OF EXEMPLARY EMBODIMENTS

Figure 10:
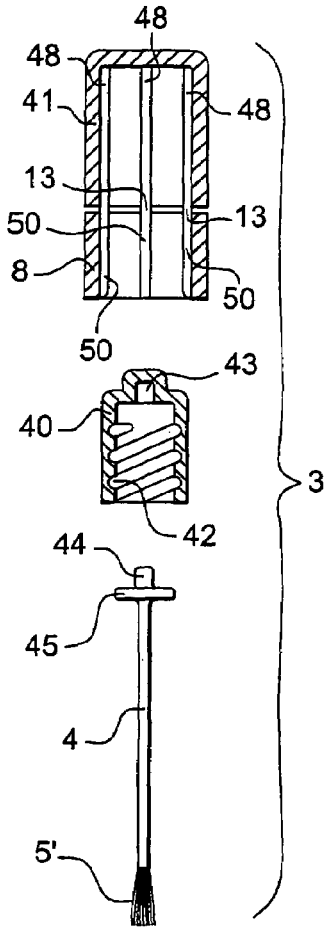
FIG. 10 shows the exemplary device in FIG. 9 after the insert has been screwed onto the neck of the flask.
Figure 10:
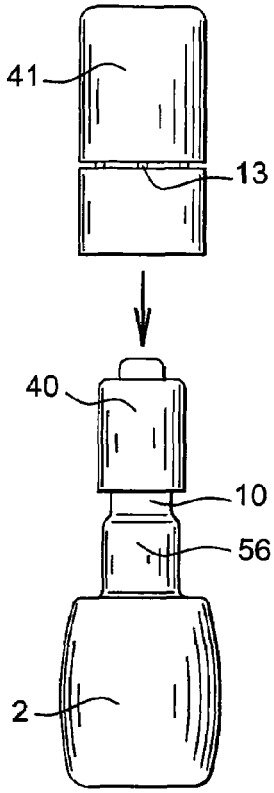
Figure 9:
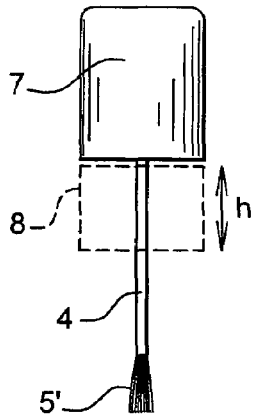
FIG. 9 is a diagrammatic exploded view showing another exemplary embodiment according to the invention.
Figure 9:
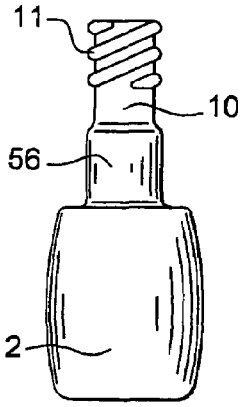

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

The exemplary embodiment of a packaging and applicator device 1 shown in FIGS. 1 to 3 comprises a flask 2, made of glass or plastics material, for example, and an applicator 3 comprising a stem 4 provided at a bottom end thereof with an applicator element 5, such as a brush, for example, and connected at a top end thereof to a closure cap 6. In the exemplary embodiment, the cap comprises a threaded portion 7 and a bottom ring 8.

For example, the stem 4 may be hollow with a tuft of brush bristles inserted therein. Further, a visible length l of the bristles may be about 12 mm or longer, for example.

The stem 4 may be fixed inside the closure cap 6 in a conventional manner. In embodiments, the stem 4 may be fixed inside the closure cap 6 by an insert which optionally also serves to close the flask 2 in a leaktight manner.

The threaded portion 7 allows for screwing onto the neck 10 of the flask 2. As shown in the exemplary embodiment, the neck 10 is provided with a thread 11.

In exemplary embodiments, the ring 8 may be initially secured to the threaded portion 7 when the applicator 3 is put into place on the flask 2 for the first time.

As shown in FIG. 6, the ring 8 may be made as a single piece together with the threaded portion 7, for example, by molding a plastics material. The ring 8 and the threaded portion 7 may be connected together by one or more breakable bridges of material 13. As shown in FIG. 6, the bridges of material 13 may be set back from a radially outer surface 19 of the ring 8 so as to avoid spoiling the appearance of the closure cap 6.

In the exemplary embodiment shown, the ring 8 has at least one first portion in relief 15, such as, for example, a bead or teeth projecting from a radially inner surface 16. The neck 10 of the flask 2 includes at a base thereof at least one second portion in relief 18 that is arranged, for example, to enable the ring 8 to be snap-fastened onto the neck 10 at the end of the initial engagement of the closure cap 6 on the flask 2.

In order to enable the ring 8 to be separated from the threaded portion 7 on unscrewing the closure cap 6, at least one anti-rotation portion in relief 20 may be provided on the radially inner surface 16 of the ring 8 that co-operates with at least one complementary portion in relief 21 formed on the neck 10. The anti-rotation portions in relief 20 and 21 may be arranged in such a manner as to enable the anti-rotation portion in relief 20 to rotate past the anti-rotation portion in relief 21 on initial engagement of the closure cap 6. For example, the anti-rotation portions in relief 20 and 21 may include respective ramps 23 and 24, for example, for this purpose. The ramps 23 and 24 may be sloped so as to assist the anti-rotation portion in relief 20 past the anti-rotation portion in relief 21 in the screw-tightening direction of the closure cap 6. The anti-rotation portions in relief 20 and 21 may subsequently prevent passage in the reverse direction.

When a user unscrews the closure cap 6 for the first time, the threaded portion 7 separates from the ring 8, which remains permanently on the neck 10. The user may thus benefit from a visible length l' of stem 4 that is sufficient to enable substance to be applied under desirable conditions, for example, to the fingernails.

Naturally, the invention is not limited to the embodiment described above. Various modifications may be applied to the flask and/or to the closure cap.

For example, the closure cap 6 may be made with a threaded portion 7 and a ring 8 which are connected together by one or more bridges of material 13 that extend substantially radially, as shown in FIG. 7, rather than extending substantially axially as shown in FIG. 6.

The ring 8 and the threaded portion 7 may also be connected together prior to the closure cap 6 being mounted on the flask 2 other than by breakable bridges of material.

For example, in the exemplary embodiment shown in FIG. 8, the threaded portion 7 and the ring 8 are arranged to co-operate by mutual engagement. The ring 8 may be provided, for example, with an annular rib 33 suitable for engaging in a shouldered housing 24 formed at a bottom end of the threaded portion 7.

In the exemplary embodiment shown in FIGS. 9 to 12, the closure cap comprises an insert 40 and an outer cap 41 in which the insert 40 may be fixed.

The insert 40 may have an inside thread 42 that enables the insert to be screwed onto the neck 10. Further, the insert 40 may have a housing 43 that enables a top end 44 of the stem 4 to be fixed to the insert 40.

The stem 4 may carry a collar 45 for bearing against an end edge of the neck 10 when the insert 40 is screwed home, for example, so as to close the flask 2 in a leaktight manner.

On a radially inner surface of the outer cap 41, one or more axial splines 48 may be provided that enable the outer cap 41 to be fixed on the insert 40, for example, by clamping. In embodiments, the outer cap 41 and the insert 40 may thus be prevented from moving relative to each other.

The ring 8 in the exemplary embodiment described above is made integrally, i.e., monolithically, with the outer cap 41. For example, the ring 8 may be connected to the outer cap 41 by one or more bridges of material 13 situated in line with the axial splines 48.

On an inner surface, the ring 8 may have one or more axial splines 50 situated in line with the axial splines 48 on the outer cap 41. The axial splines 50 may serve to bear against an enlarged portion 56 at the base of the neck 10, for example, so as to clamp sufficiently tightly to cause the ring 8 to subsequently be prevented from turning relative to the flask 2.

After the flask 2 has been filled, the insert 40 and the stem 4 may be put into place so as to close the flask 2, as illustrated in FIG. 10. Then the assembly formed by the outer cap 41 and the ring 8 may be fitted onto the insert 40 until the insert 40 comes to bear against the inside of the top wall of the outer cap 41, for example, with the axial splines 48 pressing tightly against the insert 40.

Figure 11:
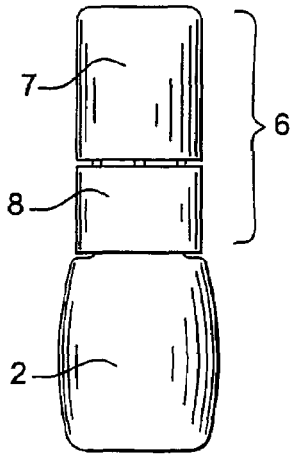
FIG. 11 shows the exemplary device in FIG. 10 after the outer cap and the ring have been put into place.
Figure 12:
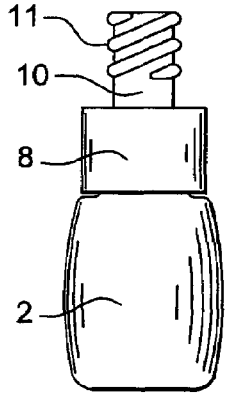
FIG. 12 shows the exemplary device in FIG. 11 after the applicator has been withdrawn.

The flask 2 provided with the closure cap 6 is illustrated in FIG. 11. During use, a user unscrews the threaded portion 7 formed by the outer cap 41 and the insert 40, while the ring 8 remains on the neck 10 of the flask by virtue of the axial splines 50 clamping onto the enlarged portion 56, as illustrated in FIG. 12. As shown in FIG. 12, it will be understood that because the ring 8 remains on the neck 10 of the flask 2, it is possible to increase the visible length of the stem 4 by the equivalent of the height h of the ring 8.

In exemplary embodiments of the present invention, the neck 10 may have a surface at the base that is not circularly cylindrical, but that is frustoconical. For example, FIG. 13 shows the flask 2, corresponding to the embodiment shown in FIGS. 1 to 5, with a frustoconical bottom portion 32 at the base of the neck 10 that enables clamping between the ring 8 and the flask 2 to be increased, for example.

Figure 14:
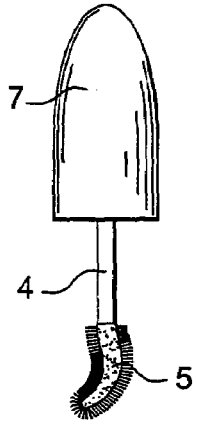
FIG. 14 a diagrammatic elevation view of an exemplary applicator including an applicator element that is flocked.

The applicator element 5 may comprise something other than a brush. For example, FIG. 14 shows a flocked applicator element 5. Such a flocked applicator element may be suited for application on lips, for example.

Figure 15:
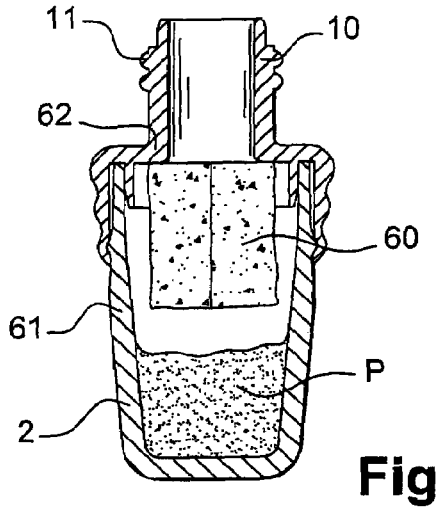
FIG. 15 is a diagrammatic and fragmentary axial section view of an exemplary embodiment of a flask including a wiper member.

The flask 2 may be made by assembling together one or more parts. For example, the flask 2 may include a wiper member 60 as shown in FIG. 15. As shown in FIG. 15, the flask 2 may comprise a body 61 having a part 62 that is fitted thereon to define the neck 10 of the flask 2 and that enables the wiper member 60 to be supported. The wiper member 60 may comprise, for example, an axially split block of foam through which the applicator element 5 can be passed. In the exemplary embodiment shown, the flask 2 may be filled with a substance P for application to the lips, for example.

Figure 16:
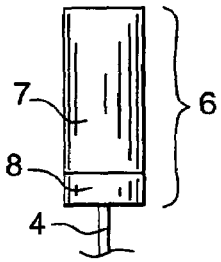
FIGS. 16 to 18 are diagrammatic and fragmentary elevation views of various exemplary embodiments of closure caps according to the invention.
Figure 17:
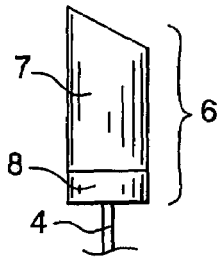
Figure 18:
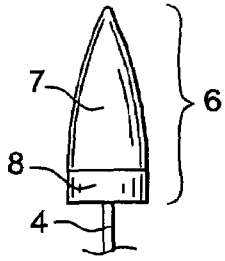

The closure cap 6 may be made in a variety of shapes, as shown in FIGS. 16 to 18. An outer section of the closure cap 6 may be circular or otherwise. For example, the outer section of the closure cap 6 may be prismatic.

Figure 19:
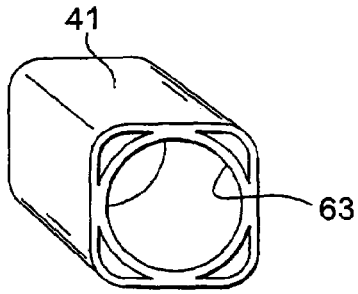
FIG. 19 is a diagrammatic perspective view of an exemplary embodiment of an outer cap in isolation, the outer cap having an outside cross-section that is not circular.

For example, FIG. 19 shows an outer cap 41 of outer cross-section that is substantially square. The outer cap 41 may have an internal circularly cylindrical wall 63 for enabling an insert to be fixed thereto. Such an insert may carry the thread of the closure cap 6 and/or the stem 4.

Throughout the description, including in the claims, the term "comprising a" should be understood as being synonymous with "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device comprising:

a flask having a capacity not greater than 10 ml and comprising a flask body and a threaded neck extending from the flask body, the flask containing a substance for application to nails; and an applicator comprising:

a fixed-length stem;

an applicator element disposed at a first end of the stem; and a closure cap supporting the stem at a second end of the stem opposite from the first end, said closure cap comprising a threaded portion arranged to screw onto the neck, wherein the closure cap comprises a ring releasably connected to the threaded portion and arranged to be capable of remaining secured to the neck during removal of the applicator;

the ring occupies substantially a same axial position before and after separation of the ring and the closure cap; and at least one of(a) a length of the stem is within a range of about 30% less than to 30% greater than a height of the neck and (b) a length of the applicator element is within a range of about 30% less than to 30% greater than a height of the flask body.

2. A device according to claim 1, wherein the threaded portion comprises an insert and an outer cap.

3. A device according to claim 2, wherein the ring and the outer cap are made monolithically by molding a plastics material, the ring and the outer cap being connected together by at least one breakable bridge of material.

4. A device according to claim 1, wherein the ring has at least one first portion in relief that enables the ring to be snap-fastened on at least one second portion in relief on the neck.

5. A device according to claim 4, wherein the second portion in relief comprises an annular bead and the first portion in relief comprises at least one of an annular bead and teeth projecting from a radially inner surface of the ring.

6. A device according to claim 1, wherein the ring is made at least in part together with the threaded portion by molding a plastics material.

7. A device according to claim 6, wherein the ring is connected to the threaded portion by at least one breakable bridge of material.

8. A device according to claim 1, wherein the ring is fitted on the threaded portion.

9. A device according to claim 8, wherein the ring has a portion in relief configured to co-operate by mutual engagement with the threaded portion.

10. A device according to claim 1, wherein the neck comprises at least one first anti-rotation portion in relief and the ring comprises at least one second anti-rotation portion in relief arranged to co-operate with the first portion in relief so as to prevent the ring from turning relative to the neck during unscrewing of the closure cap and cause separation of the threaded portion from the ring.

11. A device according to claim 10, wherein the first anti-rotation portion in relief is arranged to enable the second anti-rotation portion in relief to go past the first anti-rotation portion on initial screw fastening of the closure cap on the flask.

12. A device according to claim 11, wherein at least one of the first and second anti-rotation portions in relief comprises a ramp that facilitates movement of the first and second anti-rotation portions in relief past each other.

13. A device according to claim 1, wherein the neck comprises a base and a cylindrical surface at the base.

14. A device according to claim 1, wherein the neck comprises a frustoconical surface at a base of the neck, the frustoconical surface flaring toward a body of the flask.

15. A device according to claim 1, wherein the flask has a shoulder at a base of the neck.

16. A device according to claim 1, wherein the flask has a surface arranged to come into contact with the ring and preventing the ring from moving.

17. A device according to claim 1, wherein the ring comprises an inner surface comprising at least one spline.

18. A device according to claim 1, wherein the flask is made of glass.

19. A device according to claim 1, wherein the flask is made of a plastics material.

20. A device according to claim 1, wherein a capacity of the flask is not greater than about 8 ml.

21. A device according to claim 20, wherein a visible length of the stem plus a length of the applicator element is not less than about 25 mm.

22. A device according to claim 1, wherein a capacity of the flask is in a range of about 5 ml to about 7 ml.

23. A device according to claim 1, wherein the stem is visible when the applicator is withdrawn from the flask and the closure cap is observed in a direction perpendicular to an axis thereof.

24. A device according to claim 1, wherein the applicator element comprises a brush having bristles, and wherein a visible length of a free portion of the bristles of the brush is not less than about 12 mm.

25. A device according to claim 1, wherein a length of the stem is within a range of about 30% less than to 30% greater than the height of the neck.

26. A device according to claim 1, wherein a length of the applicator element is within a range of about 30% less than to 30% greater than the height of the flask body.

27. A method of manufacturing a packaging and applicator device as defined in claim 1, the method comprising:

providing a flask having a capacity not greater than 10 ml, including a threaded neck and containing a substance for application to nails; and screwing an applicator onto the flask, the applicator comprising:

a fixed-length stem, a length of the stem being within a range of about 30% less than to 30% greater than a height of the neck;

an applicator element disposed at a first end of the stem; and a closure cap to which the stem is secured at a second end of the stem opposite from the first end, said closure cap having a threaded portion arranged to be screwed onto the neck, the closure cap comprising a base and a ring at the base that is releasably connected to the threaded portion, the neck and the ring having shapes that co-operate so as to retain the ring on the neck when the threaded portion is unscrewed, wherein the ring occupies substantially a same axial position before and after separation of the ring and the closure cap.

28. A method of manufacturing a packaging and applicator device as defined in claim 1, the method comprising:

providing a flask having a capacity not greater than 10 ml, comprising a flask body and a threaded neck extending from the flask body, the flask containing a substance for application to nails; and screwing a threaded insert, to which a fixed-length applicator element is secured, onto the flask, a length of the applicator element being within a range of about 30% less than to 30% greater than a height of the flask body; and fitting an outer cap on the insert, the outer cap being releasably connected to a ring, the outer cap and the insert remaining secured to each other when the insert is unscrewed, the neck and the ring comprising shapes configured so as to retain the ring on the neck when the insert is unscrewed, wherein the ring occupies substantially a same axial position before and after separation of the ring and the closure cap.

29. A method for applying a substance to a portion of the human body, comprising:

loading an applicator element with substance from a flask having a capacity not greater than 10 ml and comprising a flask body and a threaded neck extending from the flask body;

removing the applicator element from the flask;

dispensing the substance to at least one of the body and the face via the applicator element, wherein the applicator element is at a first end of a fixed-length stem of an applicator, a closure cap supporting the stem is at a second end of the stem opposite from the first end, and the closure cap comprises a threaded portion arranged to screw onto the neck;

the closure cap comprises a ring releasably connected to the threaded portion, the ring remaining secured to the neck during removal of the applicator element and occupying substantially a same axial position before and after separation of the ring and the closure cap; and at least one of(a) a length of the stem is within a range of about 30% less than to 30% greater than a height of the neck and (b) a length of the applicator element is within a range of about 30% less than to 30% greater than a height of the flask body.

30. A method according to claim 29, further comprising applying the substance to nails.

31. A device comprising:

a flask having a flask body having height and comprising a threaded neck extending from the flask body, the flask containing a substance for application to nails; and an applicator comprising:

a stem;

an applicator element having a length and disposed at a first end of the stem; and a closure cap supporting the stem at a second end of the stem opposite from the first end, said closure cap comprising a threaded portion arranged to screw onto the neck;

wherein the closure cap comprises a ring releasably connected to the threaded portion and arranged to be capable of remaining secured to the neck during removal of the applicator, wherein the length of the applicator element is equal to the height of the flask body to within about 30%.

32. A device comprising:

a flask comprising a threaded neck having a length, the flask containing a substance for application to nails; and an applicator comprising:

a stem having a length;

an applicator element disposed at a first end of the stem; and a closure cap supporting the stem at a second end of the stem opposite from the first end, said closure cap comprising a threaded portion arranged to screw onto the neck;

wherein the closure cap comprises a ring releasably connected to the threaded portion and arranged to be capable of remaining secured to the neck during removal of the applicator, wherein the length of the stem is equal to the length of the neck to within about 30%.

* * * * *